US008282189B2

(12) United States Patent
Takase

(10) Patent No.: US 8,282,189 B2
(45) Date of Patent: Oct. 9, 2012

(54) INK JET PRINTING APPARATUS

(75) Inventor: Emiko Takase, Nagareyama (JP)

(73) Assignee: Canon Finetch, Inc., Misato-shi (JP)

( * ) Notice: Subject to any disclaimer, the term of this patent is extended or adjusted under 35 U.S.C. 154(b) by 373 days.

(21) Appl. No.: 12/606,687

(22) Filed: Oct. 27, 2009

(65) Prior Publication Data

US 2010/0103217 A1 Apr. 29, 2010

(30) Foreign Application Priority Data

Oct. 28, 2008 (JP) ..... 2008-276880

(51) Int. Cl.
*B41J 2/165* (2006.01)

(52) U.S. Cl. ..... 347/30; 347/29

(58) Field of Classification Search ..... None
See application file for complete search history.

(56) References Cited

U.S. PATENT DOCUMENTS 6,364,449 B1 * 4/2002 Takahashi et al. ..... 347/30
6,786,567 B1 * 9/2004 Yoshino ..... 347/36
7,354,135 B2 * 4/2008 Kimura ..... 347/36
2003/0215957 A1 * 11/2003 Lemmo et al. ..... 436/180

FOREIGN PATENT DOCUMENTS

JP 11-078065 A 3/1999
JP 2007-022036 A 2/2007

* cited by examiner

*Primary Examiner* — Matthew Luu
*Assistant Examiner* — Erica Lin
(74) *Attorney, Agent, or Firm* — Fitzpatrick, Cella, Harper & Scinto

(57) ABSTRACT

The present invention provides an ink jet printing apparatus having a plurality of caps connected to a common negative-pressure supply source, in which an optimum amount of ink can be sucked and discharged from a plurality of print heads corresponding to the respective caps in spite of a variation in channel resistance among the caps. A plurality of individual suction paths connect a common suction pump to each of the plurality of caps. An introduction condition for a negative pressure to be introduced into each of the caps is set according to the channel resistance of the corresponding individual suction path.

5 Claims, 12 Drawing Sheets

| RANK | NEGATIVE PRESSURE | | |
|---|---|---|---|
| 1 | | ~ | 0.05 |
| 2 | 0.05 | ~ | 0.1 |
| 3 | 0.1 | ~ | 0.15 |
| 4 | 0.15 | ~ | 0.2 |
| 5 | 0.2 | ~ | 0.25 |
| 6 | 0.25 | ~ | 0.3 |
| 7 | 0.3 | ~ | 0.35 |
| 8 | 0.35 | ~ | 0.4 |
| 9 | 0.4 | ~ | 0.45 |
| 10 | 0.5 | ~ | |

FIG.11

INK JET PRINTING APPARATUS

BACKGROUND OF THE INVENTION

1. Field of the Invention

The present invention relates to an inkjet printing apparatus which uses a plurality of print heads capable of ejecting ink through ink ejection ports to print an image on a print medium, the apparatus comprising a recovery unit capable of sucking and discharging the ink from each of the ink ejection ports in the plurality of print heads.

2. Description of the Related Art

As printing apparatuses, ink jet printing apparatuses are commonly used which print an image by ejecting ink to a print medium through a plurality of ink ejection ports formed in a print head. Methods for ejecting ink use electrothermal conversion element (heater), piezo element, or the like. If electrothermal conversion element is used, the electrothermal conversion element generates thermal energy in response to driving pulse so that the resulting bubbling energy can be utilized to eject ink droplet through the ink ejection port.

Some of the ink jet printing apparatuses uses, as a print head, a multi-nozzle head including integrated multiple nozzles each composed of an ink ejection port, an ink channel, and the like in order to improve an image printing speed. Furthermore, in a certain type of ink jet printing apparatuses (line printers), the print head is formed into a line head extending in a direction crossing a print medium conveying direction, and a plurality of the print heads are arranged along the print medium conveying direction. Ink is then ejected through ejection ports in the line heads in conjunction of conveyance of a print medium.

Printing apparatuses configured to print images on print media need to print images of a high resolution at a high speed. The use of the above-described ink jet printing apparatuses, including the line printers, allows this need to be satisfied.

On the other hand, since the ink jet printing apparatus handles ink, which is a fluid, the physical properties of the ink in the print head may vary. The variation in physical properties includes a variation in the viscosity of the ink associated with an environmental temperature. Furthermore, depending on the time for which the printing apparatus is left inactive, moisture in the ink may evaporate to increase the viscosity of the ink. Such a variation in ink viscosity seriously affects a recovery process described below and eventually a quality of the printed image.

As a mechanism for properly maintaining the ink ejection state of the print head, a suction recovery mechanism is known which sucks and discharges ink through the ink ejection ports of the print head (a suction recovery process). The suction recovery mechanism includes a cap configured to cap the ink ejection ports of the print head and a suction pump (negative-pressure supply source) configured to generate a negative pressure to be introduced into the cap in the capping state via a tube (suction path). The suction recovery mechanism thus sucks and discharges the ink through the ink ejection ports.

Japanese Patent Laid-Open No. H11-78065 (1999) describes a suction recovery mechanism that can perform a suction recovery process according to differences in the channel resistance of an ink channel among the print heads resulting from manufacturing errors. That is, the ink suction and discharge amount of each of the print heads is controlled according to the differences in the channel resistance of the ink channel among the print heads. The control also deals with a variation in ink viscosity caused by a variation in the physical properties of the ink depending on the environmental temperature.

Furthermore, Japanese Patent Laid-Open No. 2007-22036 describes a configuration that varies the channel resistance of a supply path through which ink is refilled, in order to adjust a difference in the amount of ink sucked and discharged which difference is caused by a difference in the opening area of the ink ejection port of the print head.

If a plurality of caps arranged opposite the respective plural print heads are each connected to one suction pump via a suction path, placing the pump and each of the caps at an equal distance from each other is difficult owing to, for example, restrictions on the printing apparatus required for miniaturization. Thus, the lengths of the suction paths vary. In this case, the ink suction and discharge amount of the print head corresponding to each cap may vary depending on the positional relationship between the cap and the suction pump. This is because the length or bending degree of the tube (suction path) connecting the cap and the suction pump together may vary depending on the positional relationship between the cap and the suction pump, causing the channel resistance to vary among the caps. For example, a cap located away from the suction pump is connected to the suction pump via a relatively long tube, which offers a relatively high channel resistance. On the other hand, a cap located close to the suction pump is connected to the suction pump via a relatively short tube, which offers a relatively low channel resistance.

Even if each tube has the same length, a tube having a large number of bent portions offers a high channel resistance. Because the bent portion has a low fluidity of a bubble kept in the tube as a foreign matter, and the bubble performs as a buffer to increase the channel resistance. Therefore, as long as there are a plurality of tubes, it is difficult to uniform the channel resistance of each of the tubes because of the difference of position on which each tube is disposed or the difference of form of each tube.

The ink suction and discharge amount of the print head corresponding to each cap varies as a result of such a difference in the channel resistance of the tube. If a tube has a high channel resistance, the print head corresponding to the tube may fail to achieve a sufficient suction and discharge process. Assuming that the negative pressure to be introduced into each of the tubes is set based on the high channel resistance, a higher negative pressure than required is applied to the print head corresponding to a tube having a low channel resistance, and from the print head an increased amount of ink may be sucked to decrease the usability of the ink. Especially, in a case where an elongated print head is used, such a decrease in the usability of the ink became conspicuous, the ink suction and discharge amount of the elongated print head increase further.

SUMMARY OF THE INVENTION

The present invention provides an ink jet printing apparatus in which if a plurality of caps are connected to a common negative-pressure supply source, an optimum amount of ink can be sucked and discharged from a plurality of print heads corresponding to the respective caps.

In an aspect of the present invention, there is provided an ink jet printing apparatus which uses a plurality of print heads capable of ejecting ink through ink ejection ports to print an image on a print medium, the apparatus comprising a recovery unit capable of sucking and discharging the ink from each of the ink ejection ports in the plurality of print heads, wherein the recovery unit comprises: a plurality of caps configured to be able to cap the ink ejection ports in each of the plurality of print heads; a negative-pressure generation unit that generates a negative pressure for acting inside of the plurality of caps; and a plurality of individual suction paths configured to individually connect each of the plurality of caps to the negative-pressure generation unit, and the ink jet printing apparatus further comprises a setting unit that sets, for the plurality of individual suction paths, an introduction condition for introducing the negative pressure generated by the negative-pressure generation unit into each of the plurality of individual suction paths.

According to the present invention, even with a possible difference in channel resistance among the individual suction paths, an optimum amount of ink can be sucked and discharged from the plurality of print heads corresponding to the respective caps. Thus, the proper ink ejection state of the print head can be maintained, and the usability of the ink can be increased by providing the ink from being excessively sucked.

Furthermore, the times to introduce negative pressures into the individual suction paths are set to overlap at least partly. This enables a reduction in the time required for the suction recovery process. Additionally, by varying the times to introduce negative pressures into the individual suction paths so as to avoid overlapping, the negative pressure corresponding to the channel resistance of each of the individual suction paths can be introduced into the individual suction path. Consequently, more optimum negative-pressure introduction conditions can be set.

Furthermore, if the moisture in the ink evaporates to increase the viscosity of the ink, the present invention executes the suction recovery process taking into account even a variation in ink channel resistance caused by the variation in viscosity. Then, the suction recovery process can be efficiently executed while avoiding sucking and discharging more amount of ink than required.

Further features of the present invention will become apparent from the following description of exemplary embodiments (with reference to the attached drawings).

BRIEF DESCRIPTION OF THE DRAWINGS

FIG. 11 is a diagram illustrating a channel resistance rank table used for the channel resistance measuring process as shown in FIG. 9.

DESCRIPTION OF THE EMBODIMENTS

An embodiment of the present invention will be described below with reference to the drawings.

First Embodiment

Figure 1:
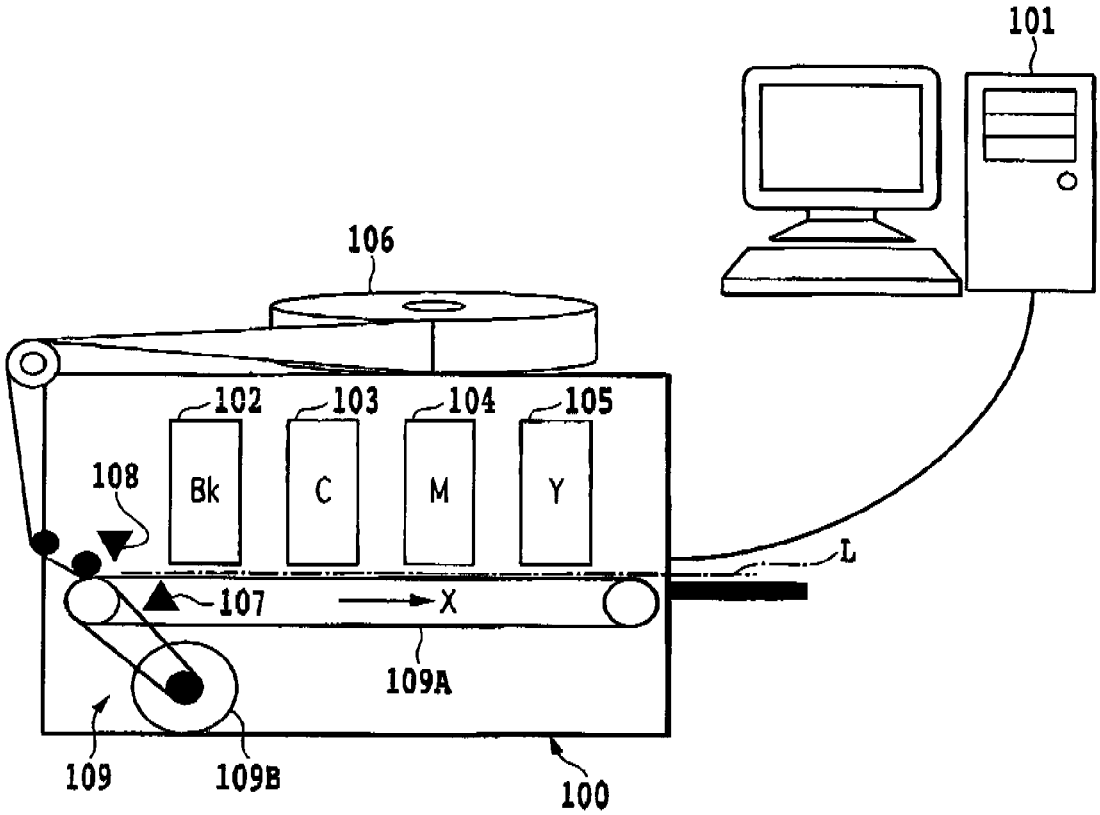
FIG. 1 is a schematic front view illustrating an example of the configuration of an ink jet printing apparatus according to a first embodiment of the present invention.

FIG. 1 is a front view schematically showing an example of the configuration of an ink jet printing apparatus according to the present invention.

An ink jet printing apparatus 100 in the present example is connected to a host PC (personal computer) 101 configured to transmit image information to the printing apparatus 100. The printing apparatus 100 includes four print heads 102, 103, 104, and 105 arranged along the conveying direction (the direction of arrow X) of roll paper (print medium) 106. A conveying mechanism 109 configured to convey the roll paper 106 is composed of a conveying belt 109A on which the roll paper 106 is placed and conveyed, a conveying motor 109B configured to rotate the conveying belt 109A, a roller (not shown in the drawings) configured to apply tension to the conveying belt 109A, and the like. The roll paper 106 is conveyed in the direction of arrow X along a conveying line L on the conveying belt 109.

The print heads 102, 103, 104, and 105 eject ink in black Bk, cyan C, magenta M, and yellow Y, respectively, toward the roll paper 106 on the conveying line L. The print heads 102, 103, 104, and 105 are what is called line heads extending in a direction crossing (in the present example, a direction orthogonal to) the conveying direction (direction of arrow X) of the roll paper 106. Furthermore, the print heads 102, 103, 104, and 105 are fixed and immobilized (immobile state) during an image printing operation A plurality of ink ejection ports are formed in each of the print heads 102, 103, 104, and 105 so as to lined along the direction crossing (in the present example, the direction orthogonal to) the conveying direction of the roll paper 106. Each of the ink ejection ports forms a nozzle together with an ink channel and an ink ejection energy generating element. Each of the print heads 102, 103, 104, and 105 is a multi-nozzle head including integrated multiple such nozzles. The ink ejection energy generating element may be an electrothermal conversion element (heater), a piezo element, or the like. If the electrothermal conversion element is used, the electrothermal conversion element generates thermal energy in response to driving pulse so that the resulting bubbling energy can be utilized to eject ink droplet through the ink ejection port.

Reference numeral 107 denotes a sensor configured to detect the position of the roll paper 106 on the conveying line L. Reference numeral 108 denotes a sensor configured to detect the tip of the roll paper 106 carried onto the conveying line L.

Figure 2:
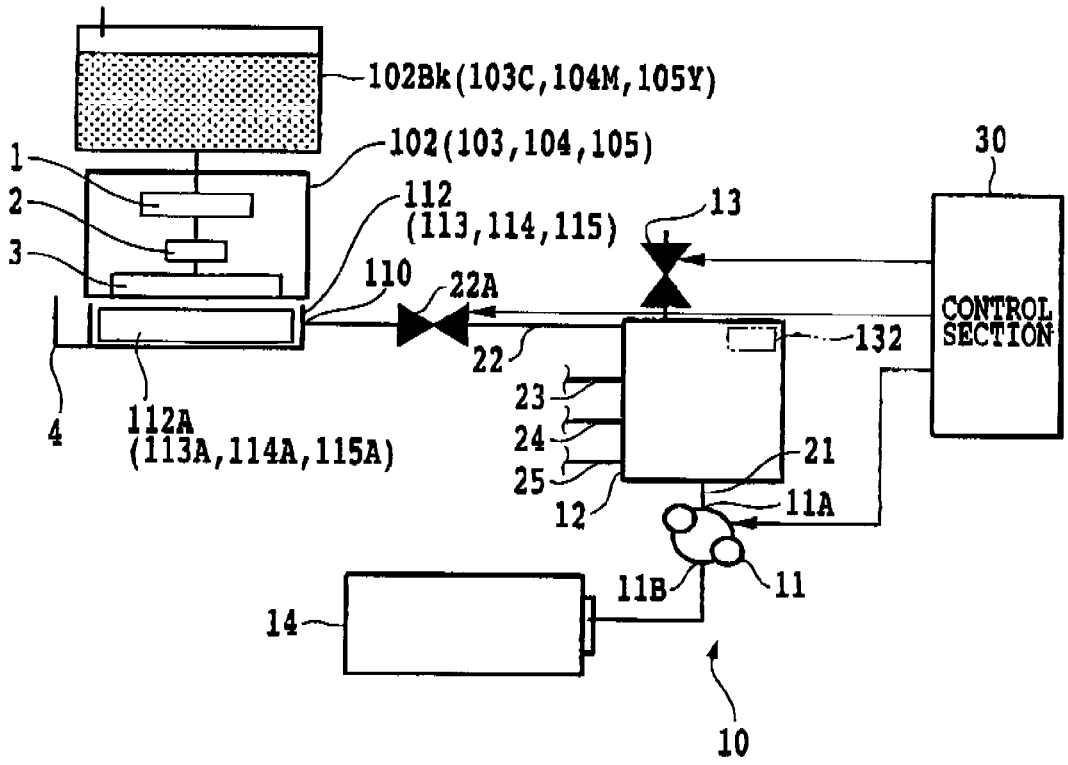
FIG. 2 is a diagram illustrating ink suction and discharge paths in a suction recovery mechanism provided in the printing apparatus in FIG. 1.

Each of the print heads 102, 103, 104, and 105 is configured as shown in FIG. 2. FIG. 2 typically shows the print head 102; the other print heads 103, 104, and 105 are similarly configured.

An ink tank 102Bk is connected to the print head 102 to supply black ink Bk. The black ink Bk is ejected downward in FIG. 2 through ink ejection port in a nozzle 3 via an outer filter 1 and a middle filter 2. Similarly, ink tanks 103C, 104M, and 105Y are connected to the print heads 103, 104, and 105 to supply ink in cyan C, magenta M, and yellow Y, respectively. The print head 102 (103, 104, and 105) can form a print head unit together with the corresponding ink tank 102Bk (103C, 104M, and 105Y). The print head unit can be replaceably incorporated into the printing apparatus 100.

Figure 3:
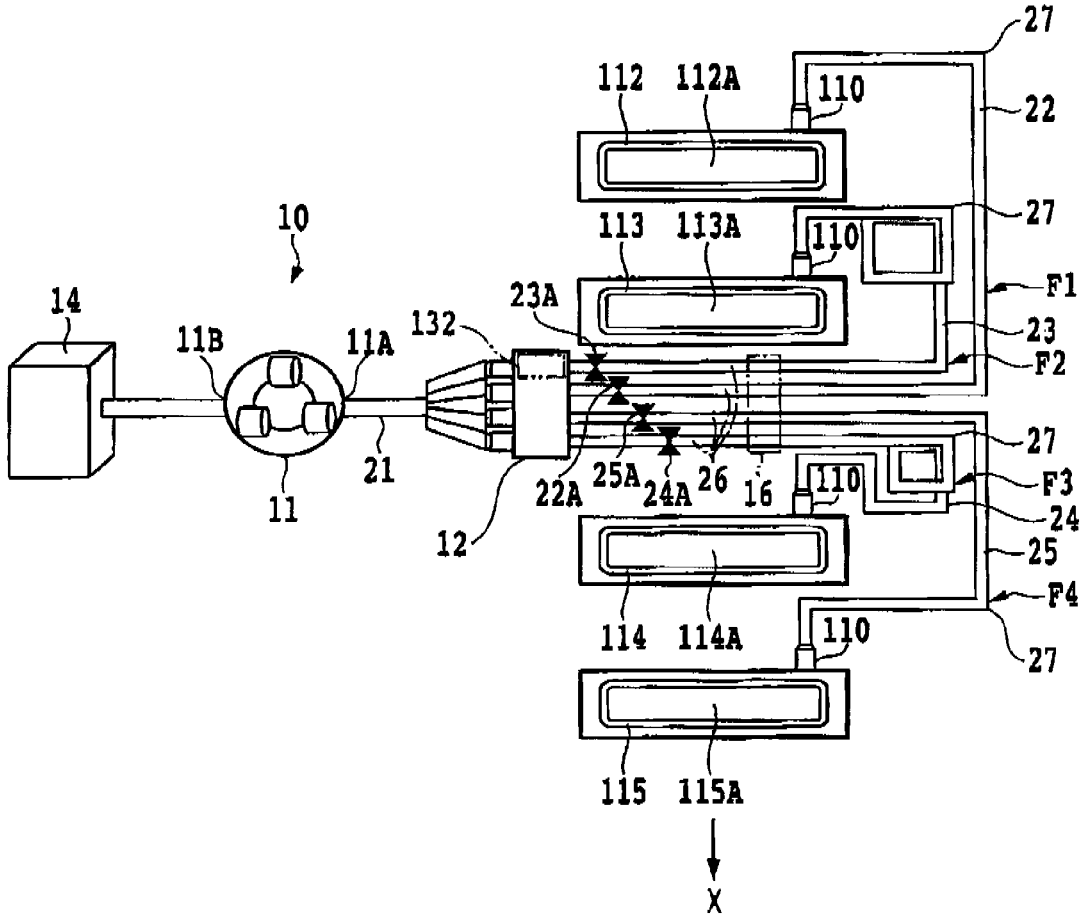
FIG. 3 is a diagram showing the configuration of essential parts of the suction recovery mechanism in FIG. 2.

The print heads 102, 103, 104, and 105 are provided with individually corresponding caps 112, 113, 114, and 115. Ink absorbents 112A, 113A, 114A, and 115A (see FIG. 3) are accommodated inside the respective caps 112A, 113A, 114A, and 115A. The caps 112, 113, 114, and 115 (see FIG. 3) move relative to the corresponding print heads 102, 103, 104, and 105 and can thus cap the ink ejection ports in the corresponding print heads 102, 103, 104, and 105 during a non-printing operation. That is, the caps 112, 113, 114, and 115 can cap the ink ejection ports in the corresponding print heads. The cap 112 is provided with a blade 4 configured to move together with the cap 112. Each of the other caps 113, 114, and 115 is also provided with the blade 4 configured to move together with the cap. In FIG. 3, the illustration of the blade 4 is omitted.

The four caps 112, 113, 114, and 115 are connected to a suction pump 11 serving as a common negative-pressure supply source as shown in FIGS. 2 and 3. Any of various types of pumps such as a tube pump may be used as the suction pump 11.

A buffer (air chamber) 12 is connected to a suction port 11A of the suction pump 11 via a common suction path 21. The interior of the buffer 12 is connected to the interior of each of the caps 112, 113, 114, and 115 via individual suction paths 22, 23, 24, and 25 corresponding to the respective caps. The individual suction paths 22, 23, 24, and 25 are provided with on-off valves 22A, 23A, 24A, and 25A. The buffer 12 is provided with an air release valve 13 configured to be able to release the interior to the air. A waste ink tank 14 is connected to a discharge port 11B of the suction pump 11. Hereinafter, a portion including the suction pump 11, the buffer 12, and on-off valves 22A, 23A, 24A, and 25A is also referred to as a negative-pressure generation unit. Reference numeral 30 denotes a control section configured to associatively control the on-off valves 22A, 23A, 24A, and 25A and the air release valve 13. As described below, the control section 30 provides the function of setting means for setting an introduction condition for a negative pressure to be introduced into the individual suction paths according to the channel resistance of each of the individual suction paths 22, 23, 24, and 25, and the function of executing a suction recovery process according to the introduction condition.

Figure 4:
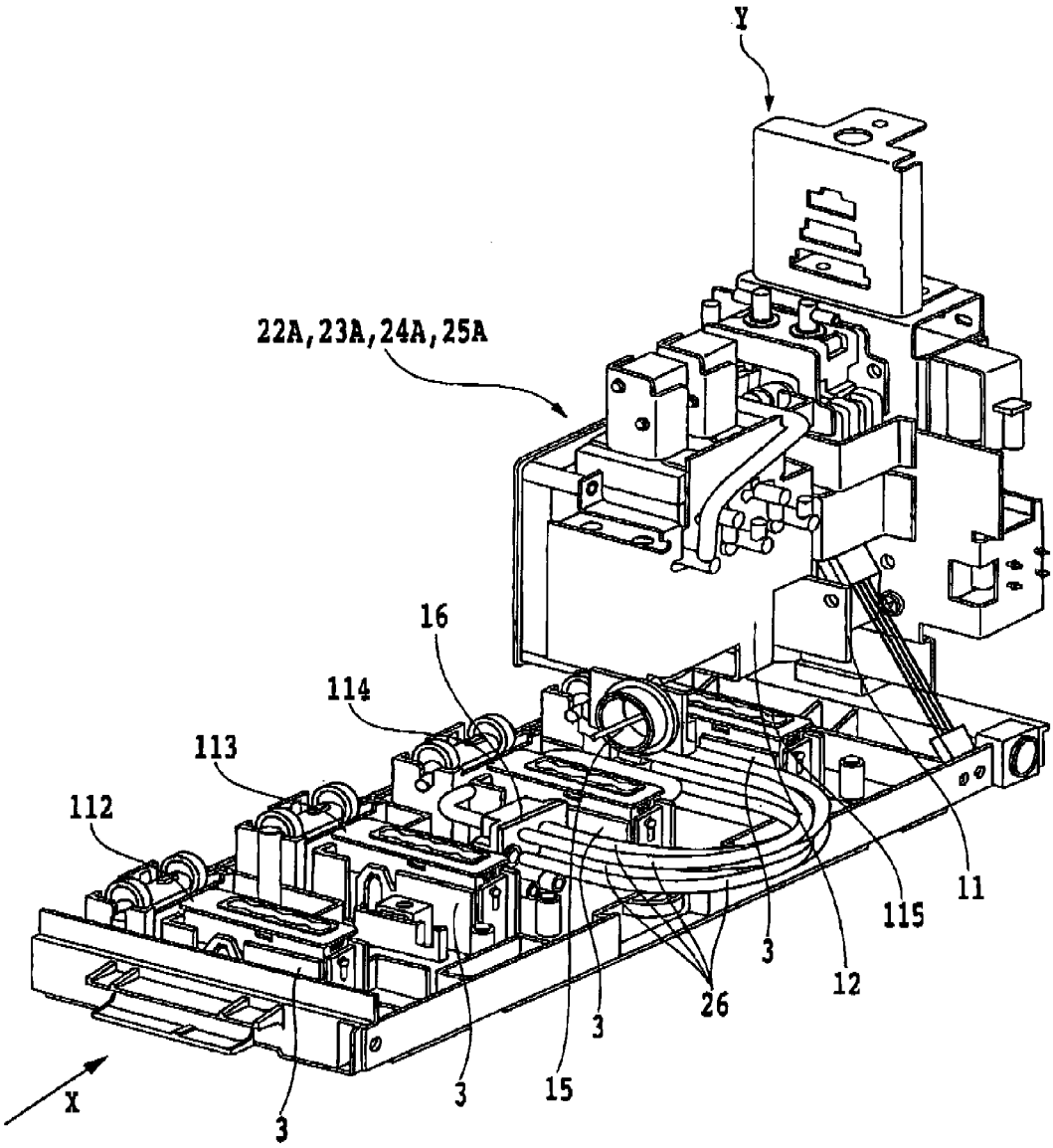
FIG. 4 is a perspective view of a recovery unit including the suction recovery mechanism in FIG. 2.

As shown in FIG. 4, the suction pump 11 and the buffer tank 12 may form a recovery unit Y together with caps 112, 113, 114, and 115, blades 3, and the like. The recovery unit Y also includes a moving mechanism for the caps 112, 113, 114, and 115 and the blades 3, the on-off valves 22A, 23A, 24A, 25A, and the air release valve 13. Reference numeral 15 denotes a waste ink discharge port connected to the discharge port 11B of the suction pump 11, and to which the waste ink tank 14 is connected. The unit Y in FIG. 4 provided with a relay connector 16. As shown in FIG. 3, the relay connector 16 is positioned to be interposed among the individual suction paths 22, 23, 24, and 25. The relay connector 16 and the buffer 12 are connected together by individual relay suction paths 26 corresponding to the individual suction paths 22, 23, 24, and 25.

In the present example, the relay connector 16 is provided between the caps 113 and 114. Thus, the caps 113 and 114 are positioned relatively close to the relay connector 16. The caps 112 and 115 are positioned relatively far from the relay connector 16. Furthermore, in the present example, conduits such as tubes forming the individual suction paths 22, 23, 24, and 25 are standardized and have almost the same length. Thus, for the individual suction paths 22 and 25 connected to the caps 112 and 115, respectively, positioned relatively far from the relay connector 16, the conduits forming the suction paths can be laid out over a large area and thus each have a reduced number of bent portions 27 at which the conduits are bent. On the other hand, for the individual suction paths 23 and 24 connected to the caps 113 and 114, respectively, positioned relatively close to the relay connector 16, the conduits forming the suction paths need to be laid out within a small area and thus each have an increased number of bent portions 27 at which the conduits are bent.

Moreover, in the present example, the caps 112, 113, 114, and 115 are standardized, and the individual suction paths 22, 23, 24, and 25 are connected to the caps 112, 113, 114, and 115, respectively, at a connection portion 110 located at the same position in the respective caps. In the caps 113 and 114 positioned relatively close to the relay connector 16, the connection portion 110 of the cap 113 is positioned relatively far from the relay connector 16. The connection portion 110 of the cap 114 is positioned relatively close to the relay connector 16. Thus, for the individual suction path 24 connected to the cap 114, the conduit forming the suction path needs to be laid out within a smaller area and thus that have a further increased number of bent portions 27 at which the conduit is bent.

If flexible tubes are used as conduits forming the individual suction paths 22, 23, 24, and 25, the bent portions 27 are shaped like circular arcs. The radius of curvature of the flexible tube is limited. An excessively small radius of curvature may result in the collapse of the tube.

An increase in the number of bent portions 27 formed in the individual suction paths 22, 23, 24, and 25 increases channel resistance. Thus, suction channels (hereinafter referred to as "suction paths F1 and F4") located between the suction pump 11 and the caps 112 and 115 and including the individual suction paths 22 and 25 offer the lowest channel resistance R as shown by A in FIG. 5. Furthermore, a suction channel (hereinafter referred to as a "suction path F2") located between the cap 114 and the suction pump 11 and including the individual suction path 24 offers the highest channel resistance R as shown by C in FIG. 5. Additionally, a suction channel (hereinafter referred to as a "suction path F3") located between the cap 113 and the suction pump 11 and including the individual suction path 23 offers a medium channel resistance R between A and C in FIG. 5, as shown by B in FIG. 5.

When an image is printed on the roll paper 106, once a print start position on the roll paper P conveyed by the conveying mechanism 109 is placed under the print head 102, the black ink Bk is selectively ejected through a plurality of ink ejection ports in the print head 102 based on print data (image information). Similarly, once the print start position on the roll paper P is placed under each of the print heads 103, 104, and 105, the corresponding ink is ejected from the respective print heads. Thus a color image is printed on the roll paper P.

During a non-printing operation, a suction recovery process can be executed by capping the ink ejection ports in the print heads 102, 103, 104, and 105 by the corresponding caps 112, 113, 114, and 115 and introducing a negative pressure into the caps. That is, the negative pressure introduced into the cap allows ink not contributing to image printing to be sucked and discharged into the cap. This enables foreign matter such as bubbles in the nozzle in the print head to be removed together with the ink. Thus, the ejection state of the ink in the print head can be kept appropriate.

In the present example, first, with the on-off vales 22A, 23A, 24A, and 25A and the air release valve 13 closed, the suction pump 11 is driven to introduce a negative pressure into the buffer 12. When the inside of the buffer 12 is set to a predetermined negative pressure, the on-off valves 22A, 23A, 24A, and 25A are opened with the suction pump 11 continuously driven. Thus, the ink can be sucked and discharged through the ink ejection ports in the print heads 102, 103, 104, and 105 into the corresponding caps 112, 113, 114, and 115. The ink sucked into the caps 112, 113, 114, and 115 is discharged from the suction paths F1, F2, F3, and F4 into the waste ink tank 14 through the buffer 12 and the pump 11.

Figure 5:
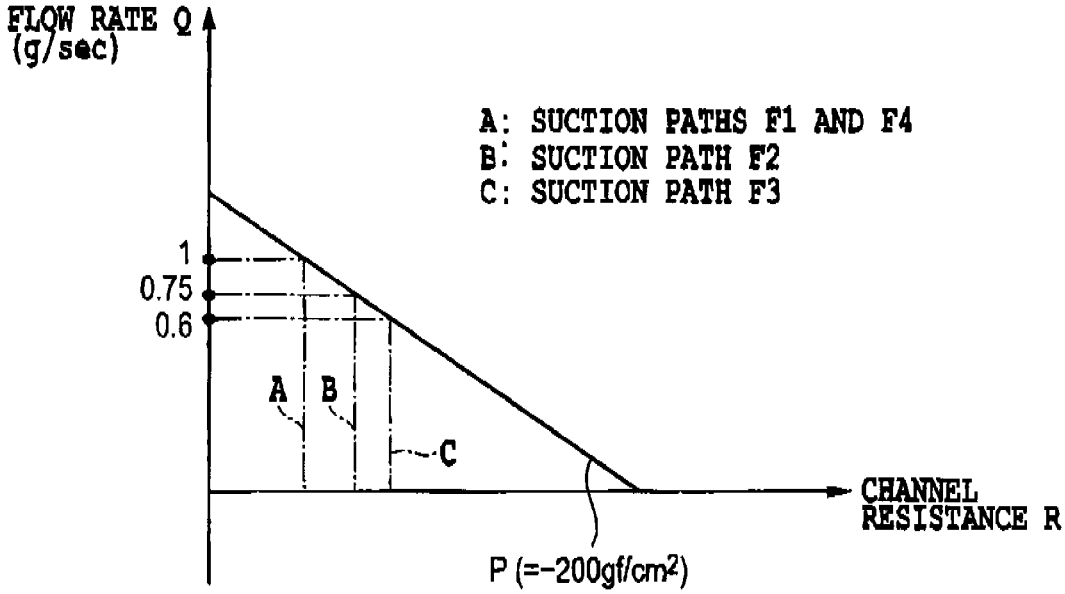
FIG. 5 is a diagram illustrating the relationship between the flow resistance and ink flow rate of each suction path in the suction recovery mechanism in FIG. 2.

If the same negative pressure P (=−200 gf/cm$^2$) is introduced into the caps 112, 113, 114, and 115, then as shown in FIG. 5, the flow rate of the ink sucked and discharged through the suction paths F1, F2, F3, and F4 varies depending on the channel resistances R of the suction paths F1, F2, F3, and F4. That is, the flow rate of ink in the suction paths F1 and F4 is 1 g/sec. The flow rate of ink in the suction path F2 is 0.75 g/sec. The flow rate of ink in the suction path F3 is 0.6 g/sec.

Figure 6:
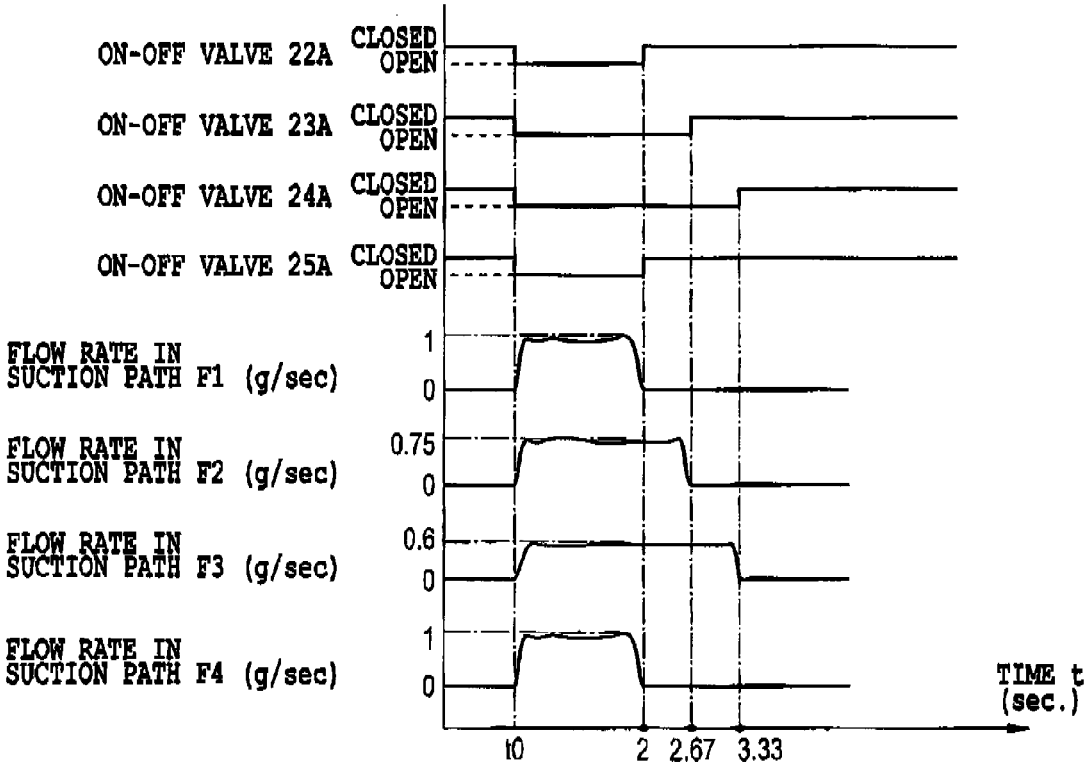
FIG. 6 is a diagram illustrating open and close timings for on-off valves in the suction mechanism in FIG. 2.

In the present example, as shown in FIG. 6, the on-off valves 22A, 23A, 24A, and 25A are opened and closed according to the above-described ink flow rates. That is, at time t0, the on-off valves 22A, 23A, 24A, and 25A are simultaneously opened to introduce the same negative pressure P (=−200 gf/cm$^2$) into the caps 112, 113, 114, and 115. Two seconds later, the on-off valves 22A and 25A are closed. Thus, 2 g of ink is sucked and discharged from the print heads 22 and 25. The on-off valve 23A is closed 2.67 seconds later. The on-off valve 24A is closed 3.33 later. Thus, 2 g of ink can also be sucked and discharged from the print heads 23 and 24.

As described above, the time at which the negative pressure is introduced into the caps 112, 113, 114, and 115 is controlled according to the channel resistances R of the suction paths F1, F2, F3, and F4. This allows the same amount of ink to be sucked and discharged from the print heads 22, 23, 24, and 25. That is, the appropriate amount of ink can be sucked and discharged from the print heads 22, 23, 24, and 25 regardless of the channel resistances R of the suction paths F1, F2, F3, and F4. This allows the following situations to be avoided: an excessively small amount of ink is sucked and discharged, precluding a sufficient suction and discharge process, and an excessively large amount of ink is sucked and discharged, that is, more ink than required is sucked and discharged.

Second Embodiment

The channel resistances of the individual suction paths 22, 23, 24, and 25 (suction paths F1, F2, F3, and F4) may vary depending on a variation in ink viscosity or in the amount of remaining ink. The ink viscosity is increased by evaporation of the moisture in the ink while the printing apparatus is left inactive. In the present embodiment, the channel resistances of the suction paths are measured as required, for example, when the printing apparatus is powered on.

Figure 7:
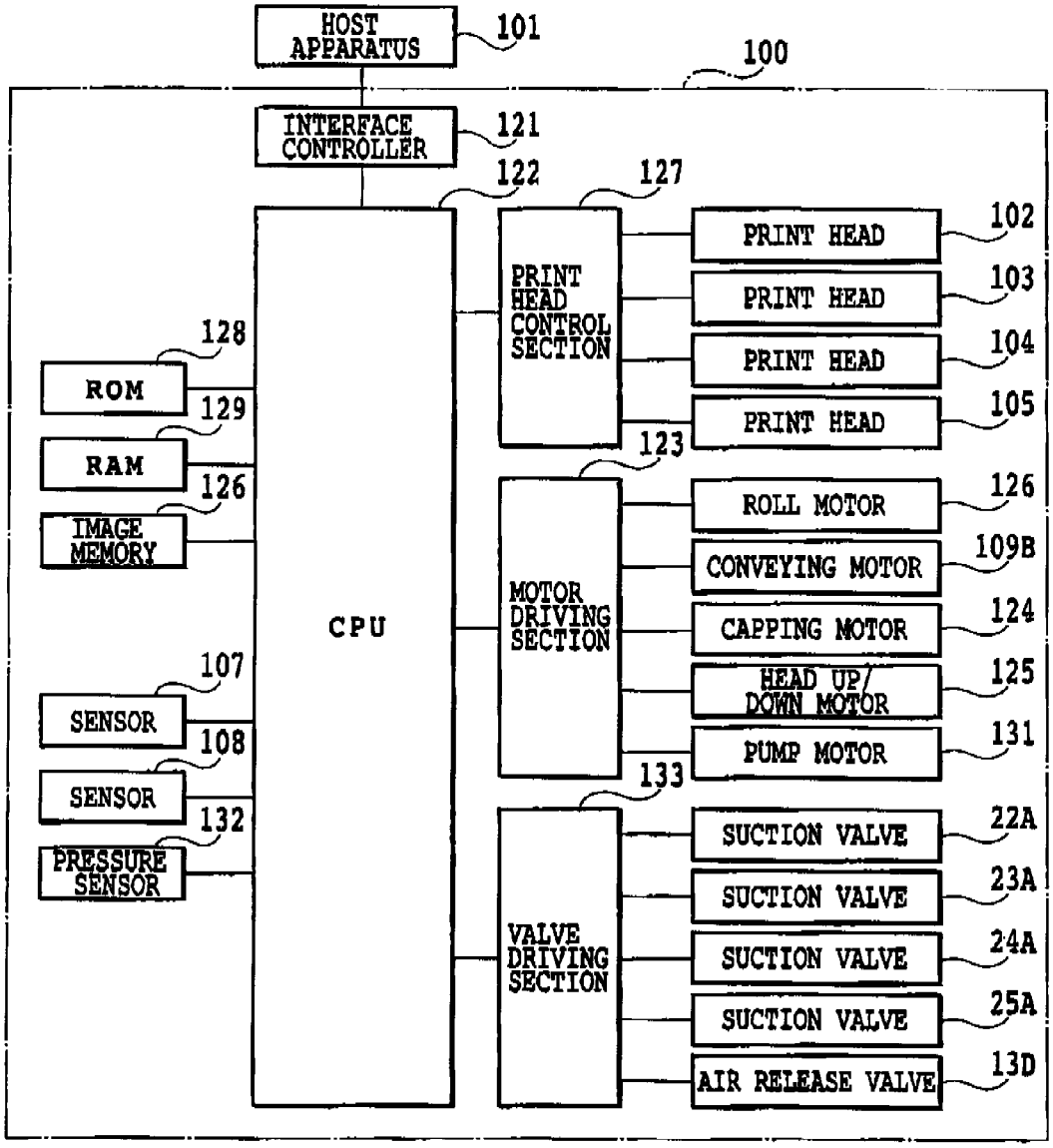
FIG. 7 is a block diagram of a control system in an ink jet printing apparatus according to a second embodiment of the present invention.

FIG. 7 is a block diagram of a control system in a printing apparatus 100 according to the present embodiment. Print data and commands transmitted by a host apparatus 101 are received by a CPU 122 via an interface controller 121. The CPU 122 is a central processing unit configured to perform control in general in the printing apparatus 100, in connection with reception of print data, a printing operation, handling of the roll paper 106, and the like. The CPU 122 analyzes a received command and then assigns image data contained in print data to print heads 102, 103, 104, and 105. Before printing, the CPU 122 cancels capping of the print heads 102, 103, 104, and 105 and moves the print heads to a print position. Specifically, the CPU 122 drives, via an output port (not shown in the drawings) and a motor driving section 123, a capping motor 124 configured to move caps 112, 113, 114, and 115 and a head up/down motor 125 configured to move the print heads 102, 103, 104, and 104 up and down.

During printing, the CPU 122 first drives, via the output port (not shown in the drawings) and the motor driving section 123, a roll motor 126 configured to deliver the roll paper 106 and the conveying motor 109B (see FIG. 1) configured to convey the roll paper 106. The roll paper 106 is thus conveyed to the print position. Thereafter, based on the time at which the sensor 108 (see FIG. 1) detects the leading end of the roll paper 106, the CPU 122 determines a timing (print start timing) for starting ejection of ink onto the roll paper 106 being conveyed at a constant speed. Thereafter, in synchronism with the conveyance of the roll paper 106, the CPU 122 sequentially reads print data from an image memory 126, and transfers the print data to the corresponding print heads 102, 103, 104, and 105 via a print head control section (control circuit) 127.

The CPU 122 performs the operation based on processing programs stored in a ROM 128. Processing programs corresponding to control described below and tables are stored in the ROM 128. Furthermore, a RAM 129 is used as a work memory. Additionally, during a cleaning operation and a recovery operation for the print heads 102, 103, 104, and 105, the CPU 122 executes a suction recovery process by driving a pump motor 131 configured to actuate the suction pump 11. Thus, the CPU 122 corresponds to the control section 30 (see FIG. 2). In the present embodiment, the buffer 12 is provided with a pressure sensor 132 configured to detect the pressure in the buffer 12 as shown by a dotted line in FIGS. 2 and 3. As described below, the CPU 122 measures the channel resistances of individual suction paths 22, 23, 24, and 25 (suction paths F1, F2, F3, and F4) based on the result of the detection by the pressure sensor 132. The CPU 122 then executes a suction recovery process according to the channel resistances. At this time, the CPU 122 opens or closes suction valves 22A, 23A, 24A, and 25A and an air release valve 13 via a valve driving section 133.

Figure 8:
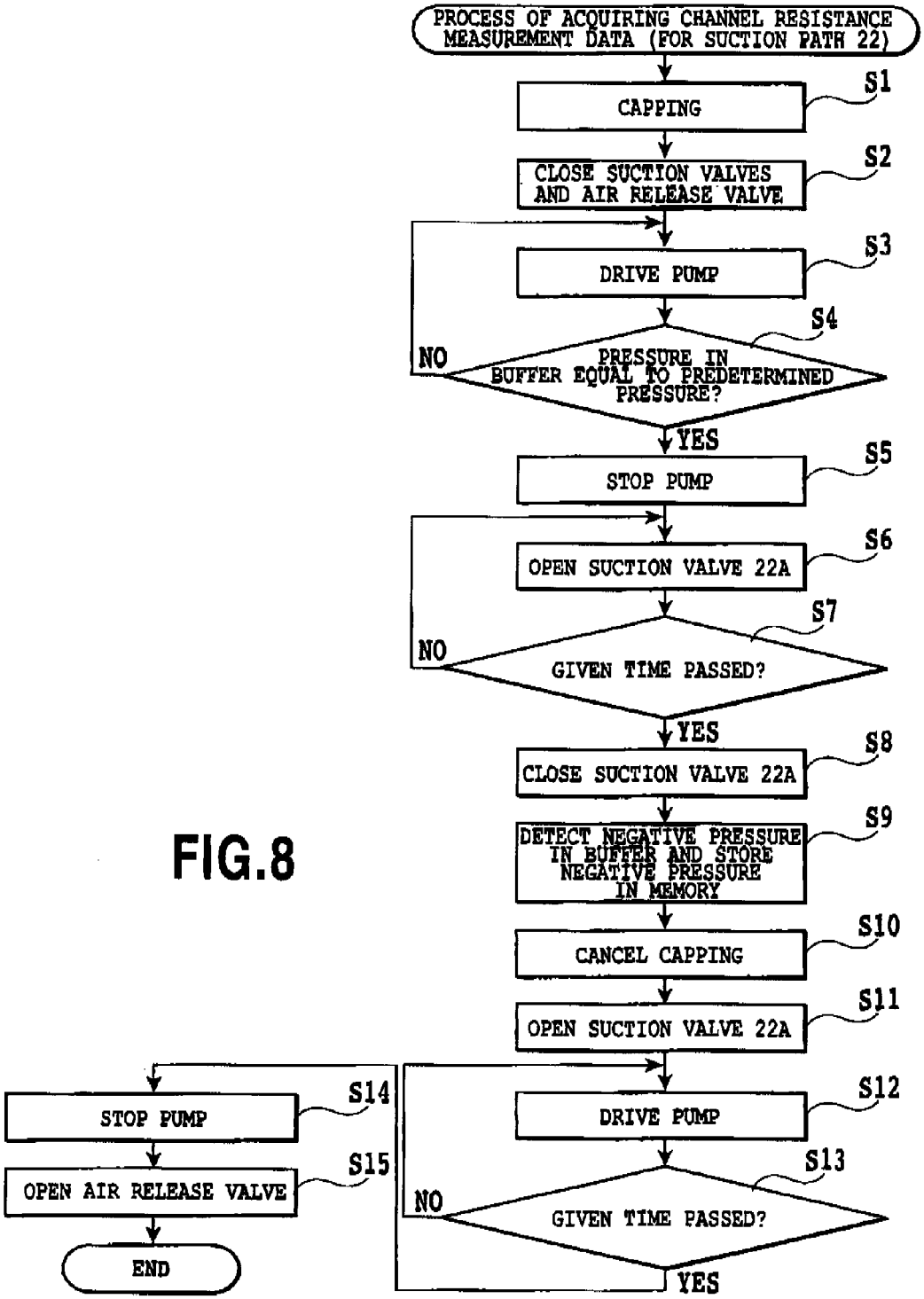
FIG. 8 is a flowchart illustrating a process of acquiring channel resistance measurement data which process is executed by the ink jet printing apparatus in FIG. 7.
Figure 9:
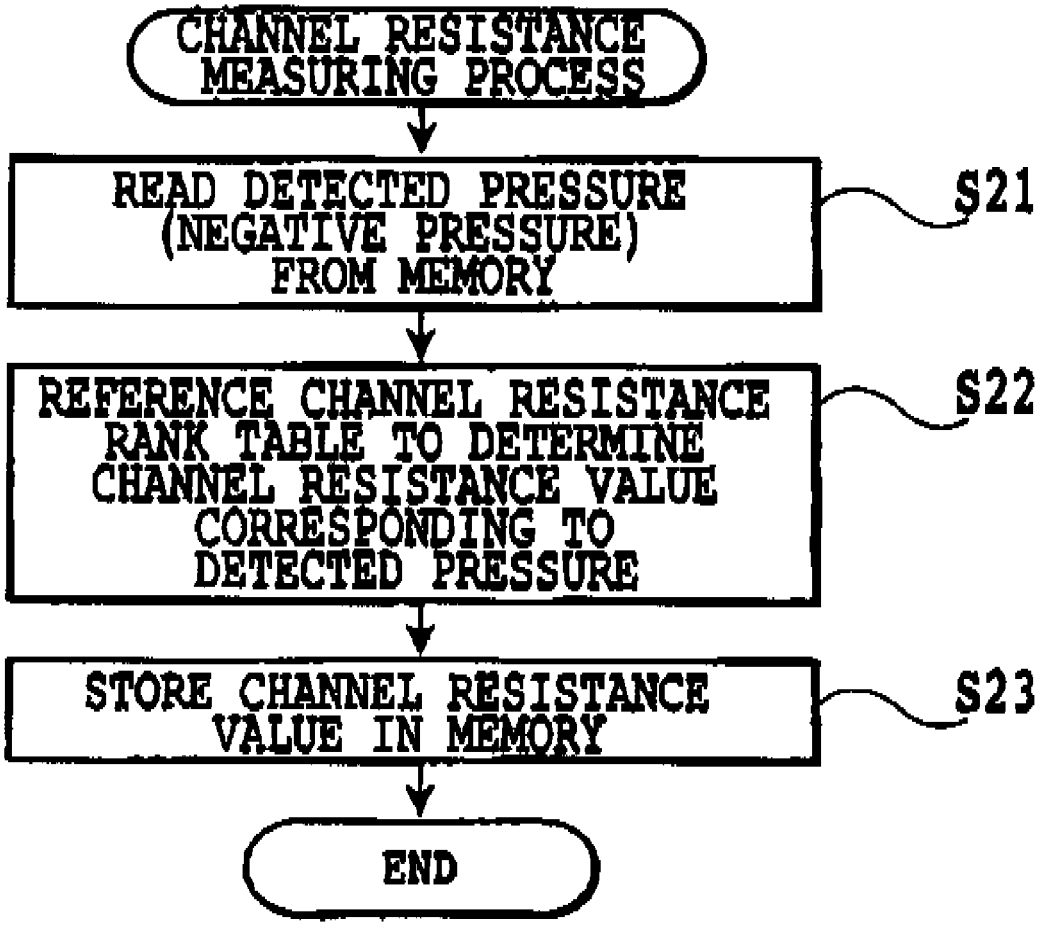
FIG. 9 is a flowchart illustrating a channel resistance measuring process executed by the ink jet printing apparatus in FIG. 7.

The CPU 122 executes a process of acquiring channel resistance measurement data as shown in FIG. 8 and a channel resistance measuring process shown in FIG. 9 to measure the channel resistances of the individual suction paths. The measurement of the channel resistance is carried out periodically or when the printing apparatus is initially installed or powered on. For example, the channel resistance may be measured during initial installation when print heads and ink tanks are set in the printing apparatus. Furthermore, if the printing apparatus is used everyday, the channel resistance may be periodically measured once per month. If the printing apparatus is powered on after being left inactive for along time, the channel resistance may be measured at the time of the power-on.

FIG. 8 is a flowchart illustrating the process of acquiring channel resistance measurement data on the suction path 22. Channel resistance measurement data on the other suction paths 23, 24, and 25 are similarly acquired.

In the processing in FIG. 8, first, from a state where the print heads 102, 103, 104, and 105 are capped by the caps 112, 113, 114, and 115 (step Si), the on-off valves (hereinafter referred to as the "suction valves") 22A, 23A, 14A, and 15A and the air release valve (hereinafter referred to as the "air release valve") 13 are closed. Thereafter, the pump 11 is driven to introduce a negative pressure into the buffer 12 (step S3). When the negative pressure in the buffer 12 detected by the pressure sensor 132 reaches a predetermined value for channel resistance measurement, the driving of the pump 11 is stopped (steps S3, S4, and S5). Then, the suction valve 22A on the suction path 22 is open for a predetermined time A (steps S6 and S7). The negative pressure in the buffer 12 is allowed to act on the print head 102 through the suction path 22 to suck and discharge ink from the print head 102. As the ink is sucked and discharged, the negative pressure in the buffer 12 decreases gradually. The predetermined time A later, the suction valve 22A is closed (step S8). The current negative pressure in the buffer 12 is detected by the pressure sensor 132, and the detected pressure is stored in a memory such as the RAM 129 (step S9).

Thereafter, the capping of the print heads 102, 103, 104, and 105 is cancelled (step S10). The suction valve 22A is opened, and the pump 11 is driven for a predetermined time (steps S12, S13, and S14). The ink sucked into the cap 112 is discharged into the waste ink tank 14 (see FIG. 3). Thereafter, the air release valve 13 is opened (step S15).

As described above, the negative pressure in the buffer 12 is detected immediately after the suction valve 22A is closed in step S8. The detected negative pressure is stored in the memory as channel resistance measurement data on the suction path 22. The detected negative pressure has a value increasing and decreasing consistently with the channel resistance of the suction path 22. The processing in FIG. 8 is similarly executed on the other suction paths 23, 24, and 25 to acquire flow resistance measurement data on each of the suction paths.

Figure 10:
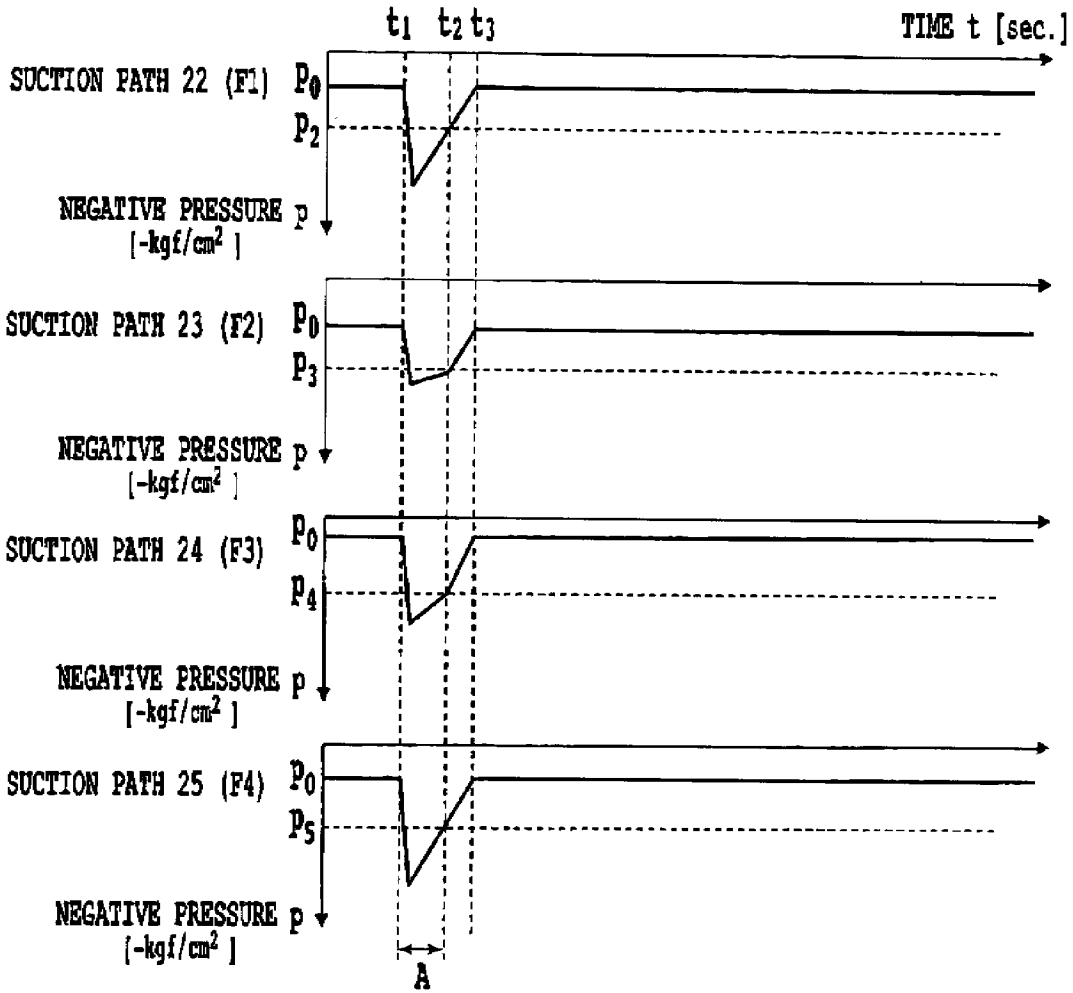
FIG. 10 is a diagram illustrating negative pressures detected during the process of acquiring channel resistance measurement data as shown in FIG. 8.

FIG. 10 is a diagram illustrating an example of a variation in the pressure in each of the suction paths 22, 23, 24, and 25 (suction paths F1, F2, F3, and F4) observed when channel resistance measurement data as described above is acquired. The axis of ordinate in FIG. 10 indicates the negative pressure in the buffer 12, which starts with atmospheric pressure P0 and increases in the direction of arrows on the axis of ordinate (downward). On the axis of abscissa (time axis) in FIG. 10, the predetermined time A corresponds to the time between t1 and t2. FIG. 10 shows that the negative pressure is introduced concurrently into the suction paths F1, F2, F3, and F4. However, as described above, the time to introduce the negative pressure into the suction paths, that is, the time to open and close the suction valves 22A, 23A, 24A, and 25A, varies. At time t1 when the suction valve is opened, the negative pressure in the suction path rises rapidly. The degree of the rise in negative pressure varies depending on the channel resistance of the suction path. Thereafter, the negative pressure in the suction path lowers gradually depending on the channel resistance of the suction path. At time t2 when the suction path is closed, the negative pressures in the suction paths F1, F2, F3, and F4 are P2, P3, P4, and P5, respectively. The negative pressures P2, P2, P4, and P5 correspond to the channel resistances of the suction paths F1, F2, F3, and F4. At time t3 when the capping is cancelled, the pressure in the suction path becomes equal to the atmospheric pressure.

Then, based on the channel resistance measurement data acquired as described above, the CPU 122 executes the channel resistance measuring process in FIG. 9 to determine the channel resistances of the suction paths 22, 23, 24, and 25 (suction paths F1, F2, F3, and F4).

That is, the CPU 122 reads the detected pressure (negative pressure) corresponding to the channel resistance measurement data from the memory (step S21). The CPU 122 references a channel resistance rank table as shown in FIG. 11 to determine the channel resistance value corresponding to the detected pressure (negative pressure) (step S22). In the present example, the channel resistance value is divided into 10 ranks according to the detected pressure (negative pressure). The channel resistance value at rank 3 in FIG. 11 corresponds to the channel resistance A of the suction paths F1 and F4 in FIG. 5. Furthermore, the channel resistance value at rank 5 in FIG. 11 corresponds to the channel resistance B of the suction path F2 in FIG. 5. The channel resistance value at rank 8 in FIG. 11 corresponds to the channel resistance C of the suction path F3 in FIG. 5. The determined channel resistance values are stored in the RAM 129 (step S23).

By controlling the time to introduce negative pressures into the caps 112, 113, 114, and 115 based on the determined channel resistance values, as is the case with the above-described first embodiment, the same amount of ink can be sucked and discharged from the print heads 22, 23, 24, and 25. Furthermore, similar processing can be used to detect a variation in channel resistance resulting from an increase in ink viscosity caused by evaporation of the moisture in the ink while the printing apparatus is left inactive, and a variation in channel resistance resulting from a variation in the amount of remaining ink.

As described above, in the present embodiment, the channel resistance of the suction path is measured based on a variation in pressure observed when a predetermined negative pressure is introduced into the suction path for a predetermined time. The variation in pressure may be, instead of the variation in pressure in the buffer 12 described above, a variation in the pressure in the suction path or in the cap. In short, the variation in pressure has only to be associated with the channel resistance of the suction path.

The buffer 12 is used to store negative pressures as described above. If a negative pressure generated by driving (for example, rotating) the pump 11 is introduced directly into the cap to suck the ink without being stored in the buffer 12, the following inconveniences may result. For example, for the pump 11 used in the present example, a long time is required to obtain a negative pressure (for example, −0.4 kgf/cm$^2$) required to maintain the reliability of the suction recovery process for the print head. During this time, the ink may be undesirably sucked and discharged as waste ink. The buffer 12 is provided in order to prevent the unwanted discharge of the ink and to instantaneously apply the negative pressure required to maintain the reliability of the suction recovery process.

Third Embodiment

In the above-described embodiments, the times to introduce negative pressures into the suction paths F1, F2, F3, and F4 overlap as shown in FIG. 6. This enables the amount of ink sucked to be controlled according to the time for which the suction valve is open. However, if the negative pressure to be introduced is set based on a suction path with a high channel resistance, a higher negative pressure than required is applied to a suction path with a low channel resistance, from which an increased amount of ink may be sucked.

Figure 12:
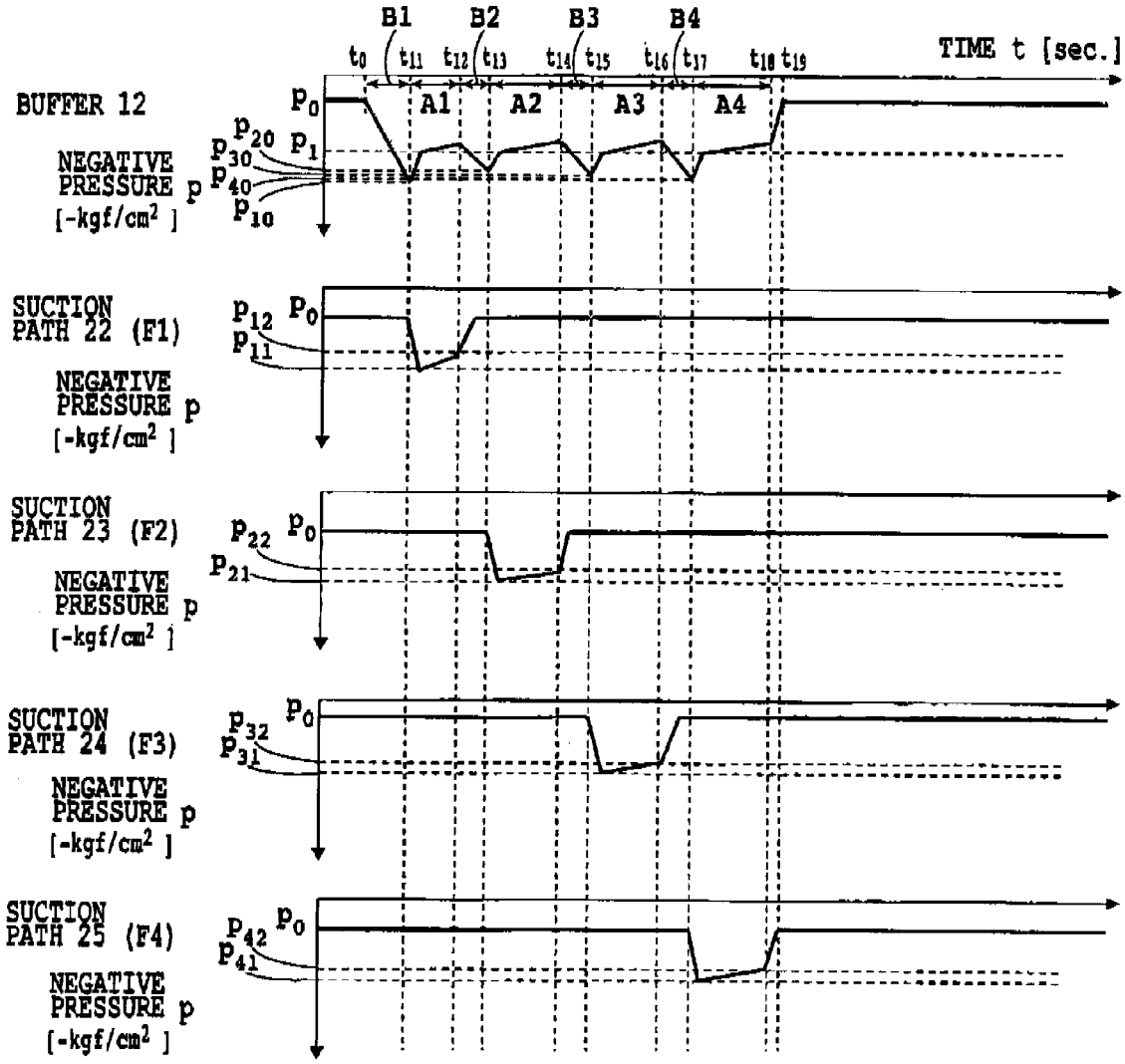
FIG. 12 is a diagram illustrating execution timings for a suction recovery process according to a third embodiment of the present invention.

In the present embodiment, as shown in FIG. 12, the times to introduce negative pressures into the suction paths F1, F2, F3, and F4 are varied so as to avoid overlapping. Thus, the magnitude of the negative pressure to be introduced and the introduction duration of the negative pressure are controlled according to the channel resistances R of the suction paths F1, F2, F3, and F4. In FIG. 12, P11, P21, P31, and P41 denote the negative pressures in the suction paths F1, F2, F3, and F4 that rise rapidly according to the channel resistances immediately after times t11, t13, t15, and t17, respectively, when a negative pressure is introduced from the buffer 12. At the times t11, t13, t15, and t17 when the negative pressure is introduced, negative pressures P10, P20, P30, and P40 corresponding to the channel resistances of the suction paths F1, F2, F3, and F4 are accumulated in the buffer 12 according to durations B1, B2, B3, and B4, respectively, for which the pump 11 is driven. Furthermore, durations A1, A2, A3, and A4 for which negative pressures are introduced into the suction paths F1, F2, F3, and F4, that is, the durations for which the suction recovery process is executed, are controlled according to the channel resistances of the suction paths F1, F2, F3, and F4. At t12, t14, t16, and t18, the suction valves corresponding to the suction paths F1, F2, F3, and F4 are closed and the capping is then cancelled. Then, the negative pressures in the suction paths F1, F2, F3, and F4 decease back to the atmospheric pressure P0.

The pump 11 is continuously driven to store the negative pressure required for the suction recovery process in the buffer 12. The continuous rotation of the pump 11 enables a reduction in time required to store the necessary negative pressure, that is, the time from the end of a suction recovery process for one print head until the beginning of a suction recovery process for the next print head.

In this manner, the suction recovery processes for the print heads 102, 103, 104, and 105 are consecutively executed. At t18, the on-off valve 25A on the suction path F4 is closed, and the capping is cancelled. Then, the driving of the pump 11 is stopped, and the air release valve 13 provided in the buffer 12 is opened to reduce the pressure in the buffer 12 back to the atmospheric pressure P0. P1 in FIG. 12 denotes the negative pressure required to maintain the reliability of the suction recovery process. By setting the negative pressures P10, P20, P30, and P40 according to the channel resistances of the suction paths or the corresponding ranks (FIG. 11), the negative pressures corresponding to the channel resistances can be introduced into the suction paths to reduce the amount of ink sucked and discharged, with the reliability of the suction recovery process maintained. As a result, the suction recovery process can be efficiently executed.

Other Embodiments

In the above-described embodiments, the channel resistance of the pipe lines forming the individual suction paths 22, 23, 24, and 25 varies depending on the number of the bent portions 27 in the pipe lines. However, the present invention can also deal with the case in which the channel resistance varies depending on the length, winding number, inner diameter, or bending degree of the pipe lines forming the individual suction paths 22, 23, 24, and 25. For example, the length of the pipe lines forming the individual suction paths 22, 23, 24, and 25 may be varied depending on the positional relationship between the relay connector 16 and each of the caps 112, 113, 114, and 115. Also in this case, as is the case with the above-described embodiments, the on-off valves 22A, 23A, 24A, and 25A may be controlled according to a variation in channel resistance resulting from a variation in the length of the pipe.

Alternatively, the on-off valves 22A, 23A, 24A, and 25A may be controlled according to at least one of the amount of ink remaining in the ink tanks 122, 123, 124, and 125 and a increase in the viscosity of the ink in the ink tanks 122, 123, 124, and 125 caused by a time-dependent change. Thus, the introduction condition for the negative pressure to be introduced into each of the plurality of individual suction paths can also be set according to the amount of ink remaining in the ink tank and/or the increase in the viscosity of the ink in the ink tank caused by the time-dependent change.

Furthermore, the individual suction paths 22, 23, 24, and 25 may be connected to the buffer 12 without passing through the relay connector 16 or directly to the suction pump 11. In short, it is only necessary that a plurality of caps can be individually connected to a common negative-pressure supply source such as a suction pump.

Furthermore, in the above first embodiment, the introduction of the negative pressure of the same magnitude into the caps 112, 113, 114, and 115 is simultaneously started. The time to end the introduction of the negative pressure is varied according to the flow resistances R of the suction paths F1, F2, F3, and F4. That is, the duration for which the same negative pressure is introduced (the duration for which ink is sucked and discharged from the print head) is controlled according to the channel resistances R of the suction paths F1, F2, F3, and F4. However, the time to start the introduction of the negative pressure into the caps 112, 113, 114, and 115 need not necessarily be the same but may be varied. Alternatively, the time to start the introduction of the negative pressure into the caps 112, 113, 114, and 115 may be varied so as to vary the magnitude of the negative pressure to be introduced into the respective caps depending on the channel resistances R of the suction paths F1, F2, F3, and F4. In this case, the duration for which the negative pressure is introduced (the duration for which ink is sucked and discharged from the print head) can be equalized among the caps. In short, it is only necessary that the same amount of ink can be sucked and discharged from the print heads 22, 23, 24, and 25 regardless of the channel resistances R of the suction path F1, F2, F3, and F4.

The control section 30 associatively controls the pump 11, the on-off valves 22A, 23A, 24A, and 25A, and the air release valve 13 according to the pre-acquired channel resistances R of the suction paths F1, F2, F3, and F4. The control section 30 can thus execute the optimum suction recovery process as described above.

Furthermore, the control section 30 can execute a suction recovery process also taking the flow characteristics (viscosity and the like) of the ink into account. For example, if the ink has a high viscosity, the negative pressure required to suck the ink tends to increase. Thus, by controlling the magnitude of the negative pressure or the introduction duration of a negative pressure of the same magnitude according to the viscosity of the ink, a more appropriate suction recovery process corresponding to the ink type can be executed.

Others

The present invention is widely applicable to an ink jet printing apparatus which uses a plurality of print heads capable of ejecting ink through ink ejection ports to print an image on a print medium and in which the ink can be sucked and discharged through each of the ink ejection ports of the plurality of print heads. Thus, the configuration of the printing apparatus is not limited to the above-described full line type but may be a serial scan type. The full line type has only to comprise an installation section in which the plurality of print heads can be installed so as to be staggered in a predetermined direction and conveying means for conveying the print medium along the predetermined direction. A plurality of caps may be provided in association with the installation positions of the plurality of print heads.

Furthermore, the number of print heads provided is not limited to four but may be optional. Additionally, a native-pressure supply source (negative-pressure supply means) configured to supply a negative pressure to the inside of caps may be any of various pumps other than a tube pump. In addition, it is only necessary that the introduction condition for negative pressures to be introduced into the plurality of caps can be set according to the channel resistances of a plurality of individual suction paths corresponding to the respective caps.

As the negative-pressure introduction condition, at least one of the time to introduce a negative pressure into each of the plurality of individual suction paths and the magnitude of the negative pressure to be introduced can be set. The time to introduce the negative pressure can be set according to the time to open and close on-off vales provided in the respective plural individual suction paths. In this case, the time to open the on-off vales in the respective plural individual suction paths can be set such that the on-off valves are simultaneously opened, with the time to close the on-off valves varied according to the channel resistances of the individual suction paths.

Alternatively, the negative-pressure introduction condition can be set according to at least one of the type of ink ejected from the print head and the environmental temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-276880, filed Oct. 28, 2008, which is hereby incorporated by reference herein in its entirety.

What is claimed is:

1. An ink jet printing apparatus which uses a plurality of print heads capable of ejecting ink through ink ejection ports to print an image on a print medium, the ink jet printing apparatus comprising a recovery unit capable of sucking and discharging the ink from each of the ink ejection ports in the plurality of print heads, wherein the recovery unit comprises:

a plurality of caps configured to be able to cap the ink ejection ports in each of the plurality of print heads;

a negative-pressure generation unit that generates a negative pressure for acting inside of the plurality of caps; and a plurality of individual suction paths configured to individually connect each of the plurality of caps to the negative-pressure generation unit; and a plurality of valves, each valve respectively provided in each of the plurality of individual suction paths so as to open and close each of the plurality of individual suction paths, wherein the ink jet printing apparatus further comprises a control section configured to control each of the plurality of valves so as to open the plurality of valves concurrently and to close the plurality of valves individually, timings for closing each of the plurality of valves becoming later as a channel resistance of the corresponding individual suction path becomes higher.

2. The ink jet printing apparatus according to claim 1, further comprising:

an installation section in which the plurality of print heads can be installed so as to be staggered in a predetermined direction; and a conveying unit that conveys the print medium along the predetermined direction, wherein the plurality of caps are staggered in the predetermined direction in association with the installation positions of the plurality of print heads.

3. The ink jet printing apparatus according to claim 1, wherein the control section controls the times to introduce the negative pressures into the plurality of individual suction paths so as to avoid overlapping of the times.

4. The ink jet printing apparatus according to claim 1, wherein the negative-pressure generation unit includes a suction pump and an air chamber in which a negative pressure generated by the suction pump is accumulated, the air chamber is connected to the plurality of individual suction paths, and a discharge port of the suction pump is connected to a waste ink tank.

5. The ink jet printing apparatus according to claim 1, further comprising a measurement portion configured to measure the channel resistance of each of the individual suction paths based on a variation in pressure observed when the negative-pressure generation unit introduces a negative pressure into the individual suction path, wherein the control section controls a period for introducing the negative pressure into each of the plurality of individual suction paths according to the channel resistance of the individual suction path measured by the measurement.

* * * * *